US005212909A

United States Patent [19]

Morin

[11] Patent Number: 5,212,909

[45] Date of Patent: May 25, 1993

[54] PASSAGE HAVING CONTROLLED ACCESS PROVIDED BY A CLOSURE DEVICE USING A BARRIER HINGED ABOUT A VERTICAL AXIS

[75] Inventor: Claude Morin, La Celle Saint Cloud, France

[73] Assignee: Compagnie Generale D'Automatisme CGA HBS, Bretigny Sur Orge, France

[21] Appl. No.: 783,814

[22] Filed: Oct. 29, 1991

[51] Int. Cl.[5] ..... E01F 13/00

[52] U.S. Cl. ..... 49/49; 49/35; 49/257

[58] Field of Search ..... 49/35, 49, 257, 258, 49/260, 324, 340

[56] References Cited

U.S. PATENT DOCUMENTS

| | | | |
|---|---|---|---|
| 3,742,647 | 7/1973 | Tomita | 49/35 |
| 4,301,622 | 11/1981 | Dunsmoor | 49/260 |
| 4,472,908 | 9/1984 | Wanzl et al. | 49/49 |

*Primary Examiner*—Peter M. Cuomo
*Assistant Examiner*—Michael Milano
*Attorney, Agent, or Firm*—Sughrue, Mion, Zinn, Macpeak & Seas

[57] ABSTRACT

A passage (1) with monitored authorization of access is provided with a closure device using a barrier (2) hinged about a vertical axis $\gamma$. The passage includes at least one such barrier (2) with an end thereof situated adjacent to the vertical axis $\gamma$. Rectilinear guides (6 to 9) guide the axis $\gamma$ along a line $\Delta$ parallel to the through direction of the passage. The barrier is further provided with a hinged link (4) which is hinged firstly about a vertical axis $\gamma_1$ situated along the barrier (2), and secondly about a vertical axis $\gamma_2$ situated in the vicinity of the line $\Delta$. A drive system (10 to 13, 22 to 24) opens and closes the passage by causing the vertical axis $\gamma$ to slide along the line $\Delta$. The vertical axis $\gamma$ is situated at a distance l from the line $\Delta$. The length of the barrier (2) between the vertical axis $\gamma$ and the vertical axis $\gamma_1$ is equal to L. The passage is characterized in that the length $L_1$ of the link (4) between the axes $\gamma_1$ and $\gamma_2$ is equal to $L-\int$, and in that the vertical axis $\gamma_2$ is tied to a carrier (15) supporting the hinge of the link (4). Further, the drive system (16 to 18) enables the carriage (15) to be displaced in a direction parallel to the line $\gamma$. Locks (19, 21) are provided for locking the carriage in two distinct positions along the stroke of the carriage (15).

3 Claims, 3 Drawing Sheets

PASSAGE HAVING CONTROLLED ACCESS PROVIDED BY A CLOSURE DEVICE USING A BARRIER HINGED ABOUT A VERTICAL AXIS

The present invention relates to a passage having controlled access provided by a closure device using a barrier hinged about a vertical axis.

It is known to make use of gates having two vertical access barriers for closing passages having controlled access.

The gates are normally open, and they are closed ahead of a passerby only when access is refused.

Such gates must be capable of closing fast enough and they must also avoid running any risk of injuring users.

French patent No. 2 053 549 describes a gate satisfying these requirements: very good user safety, fast closing, and suitable for use with short distances between users, thus enabling high throughput. However, the device described in that document does not allow the direction that users pass through it to be reversed.

The invention provides a passage having controlled access with the same advantages as those in the abovementioned document, but in which the passenger travel direction can be reversed.

The present invention thus provides a passage having controlled access provided with a closure device using a barrier hinged about a vertical axis $\gamma$, said passage including at least one such barrier with the end thereof situated adjacent to said vertical axis $\gamma$ including rectilinear guide means for guiding said axis $\gamma$ along a line $\Delta$ parallel to the through direction of said passage, said barrier further being provided with a hinged link which is hinged firstly about a vertical axis $\gamma_1$ stiuated along said barrier, and secondly about a vertical axis $\gamma_2$ situated in the vicinity of said line $\Delta$, drive means opening and closing said passage by causing said vertical axis $\gamma$ to slide along said line $\Delta$, said vertical axis $\gamma_2$ being situated at a distance l from said line $\Delta$, the length of said barrier between the vertical axis $\gamma$ and the vertical axes $\gamma_1$ being equal to L, the passage being characterized in that the length $L_1$ of said link between the axis $\gamma_1$ and $\gamma_2$ is equal to L-l, in that the vertical axis $\gamma_2$ is tied to a carriage supporting the hinge of said link, and in that drive means enable said carriage to be displaced in a direction parallel to said line $\gamma$, locking means being provided for locking said carriage in two distinct positions along the stroke of the carriage.

An embodiment of the invention is described below with reference to the accompanying drawings, in which.

Figure 1:
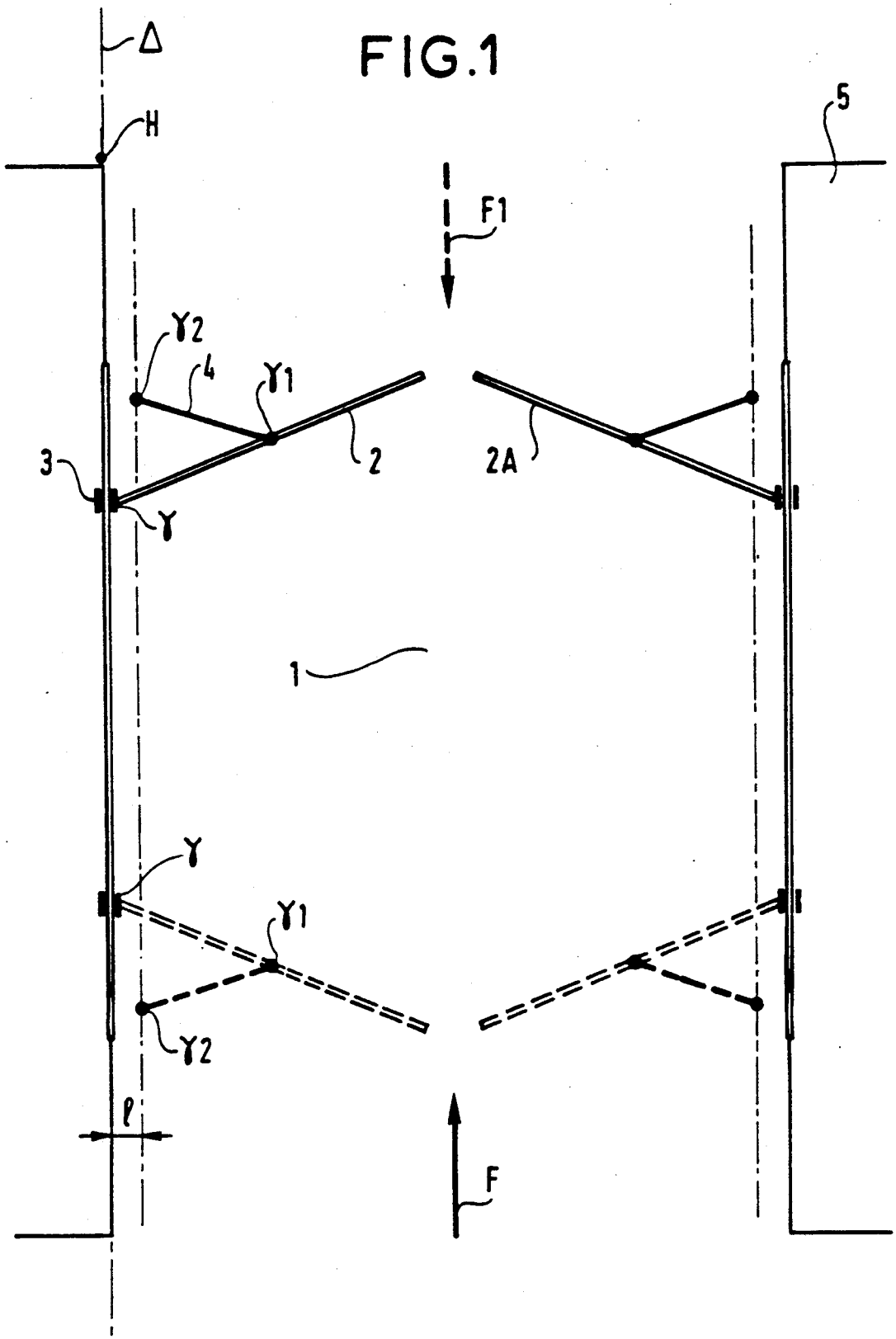
FIG. 1 is a theoretical diagram showing a passage having controlled access and fitted with a closure device of the invention.

With reference to FIG. 1 which is a theoretical diagram, there can be seen a passage 1 which is a passage through which access is controlled, e.g. by means of a ticket whose validity is verified. Such a passage is commonplace, particularly in public transportaiton networks such as the Metro.

The passage is provided with a gate having two barriers 2 and 2A. The forwards direction is marked by an arrow F.

It is advantageous for the passage to have two barriers, but it could be provided with one barrier only, and the description below relates to one barrier 2 only, but is equally applicable to the other barrier 2A.

The barrier 2 is hinged at its non-free end about a vertical access $\gamma$. The hinge axis $\gamma$ is connected to rectilinear guide means 3 for guiding along a line $\Delta$ parallel to the through direction. A link 4 is also hinged about a vertical axis $\gamma_1$ situated along the barrier 2 and about a vertical axis $\gamma_2$ situated in the vicinity of $\Delta$.

For travel in a given direction, the axis $\gamma_2$ is fixed. When it is desired to reverse the travel direction, the assembly is displaced in translation to the position shown in dashed lines, in which position the new position of the axis $\gamma_2$ is again fixed.

Operation is as follows: the passage is normally open, i.e. the barrier 2 is disposed against the line $\Delta$ with the axis $\gamma 0$ having slid downwards in the figure and with the link 4 having pivoted about the axis $\gamma_2$.

When a ticket inserted by a user in a terminal inlet reader 5 is recognized as being invalid, or when no ticket is inserted at all, the gate closes automatically by the axis $\gamma$ being slid upwards in the figure.

It will be observed that while the barrier 2 is moving towards its closed position, no point on the barrier has a longitudinal component of motion in the opposite direction to the direction F in which passengers are advancing, but on the contrary all points move in this advance direction, thereby ensuring that device is very safe. The device also makes a large throughput possible: the barrier can start being closed in front of an unauthorized user as soon as the preceding user has gone past the axis $\gamma_2$.

Figure 2:
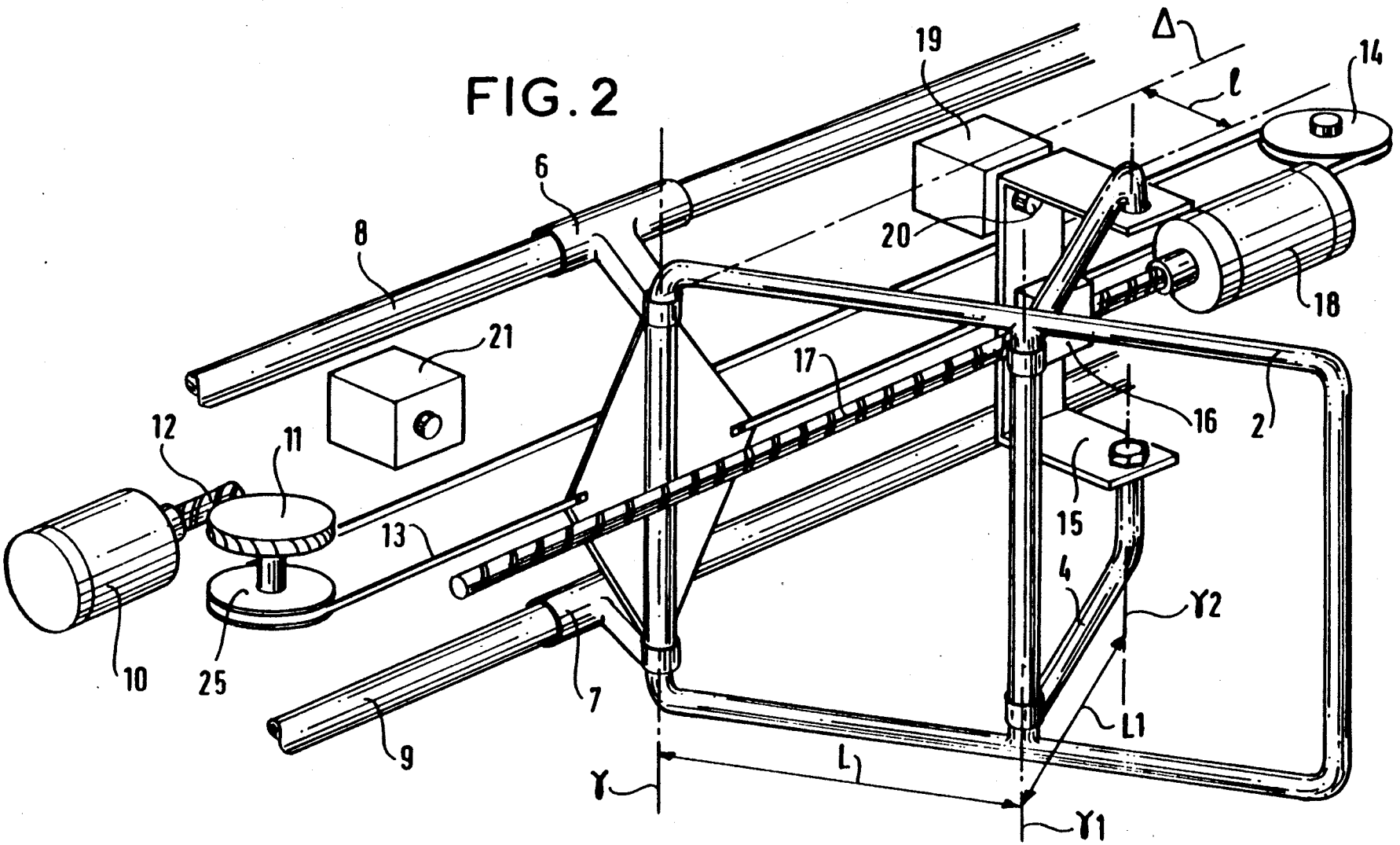
FIG. 2 is a perspective view of a barrier of the invention.

FIG. 2 shows a practical example of a barrier 2 together with its complete drive means enablign the through direction to be reversed.

To reverse the through direction, the axis $\gamma_2$ which must be capable of passing to the other side of the axis $\gamma$ is situated at a distance l from the line $\Delta$ and on the same side of said line $\Delta$ as the axis $\gamma_1$. It is then necessary for the length $L_1$ of the link between the axes $\gamma_1$ and $\gamma_2$ to be equal to L-l, where L is the distance between $\gamma$ and $\gamma_1$. In this example, the axis $\gamma$ of the barrier 2 is guided along the vertical plane defined by the line $\Delta$ by sleeves 6 and 7 that slide along two rods 8 and 9.

The barrier 2 is opened and closed by a motor 10 which acts directly by pulling the sliding end of the barrier 2 via a gear wheel 11 meshing with the shaft 12 of the motor via a worm screw. The shaft of the gear wheel 11 carries a pulley 25 having a drive belt 13 passing thereover and fixed to the sliding end of the barrier 2. The belt 13 also passes over a return pulley 14.

To enabling the through direction to be reversed, i.e. to enable the entire assembly to be moved in translation from the position shown in solid lines in FIG. 1 to the position shown in dashed lines, the hinge axis $\gamma_2$ of the link 4 is mounted on a hinge support carriage 15 which includes a tapped nut 16 with a threaded rod 17 that can be rotated by a motor 18 passing therethrough.

When the assembly has reached its final position, this is detected and an electromagnet 19 locks the carriage 15 by inserting its bolt 20 into an orifice in the carriage 15. For the opposite through direction, the carriage 15 is locked by an electromagnet 21.

Figure 3:
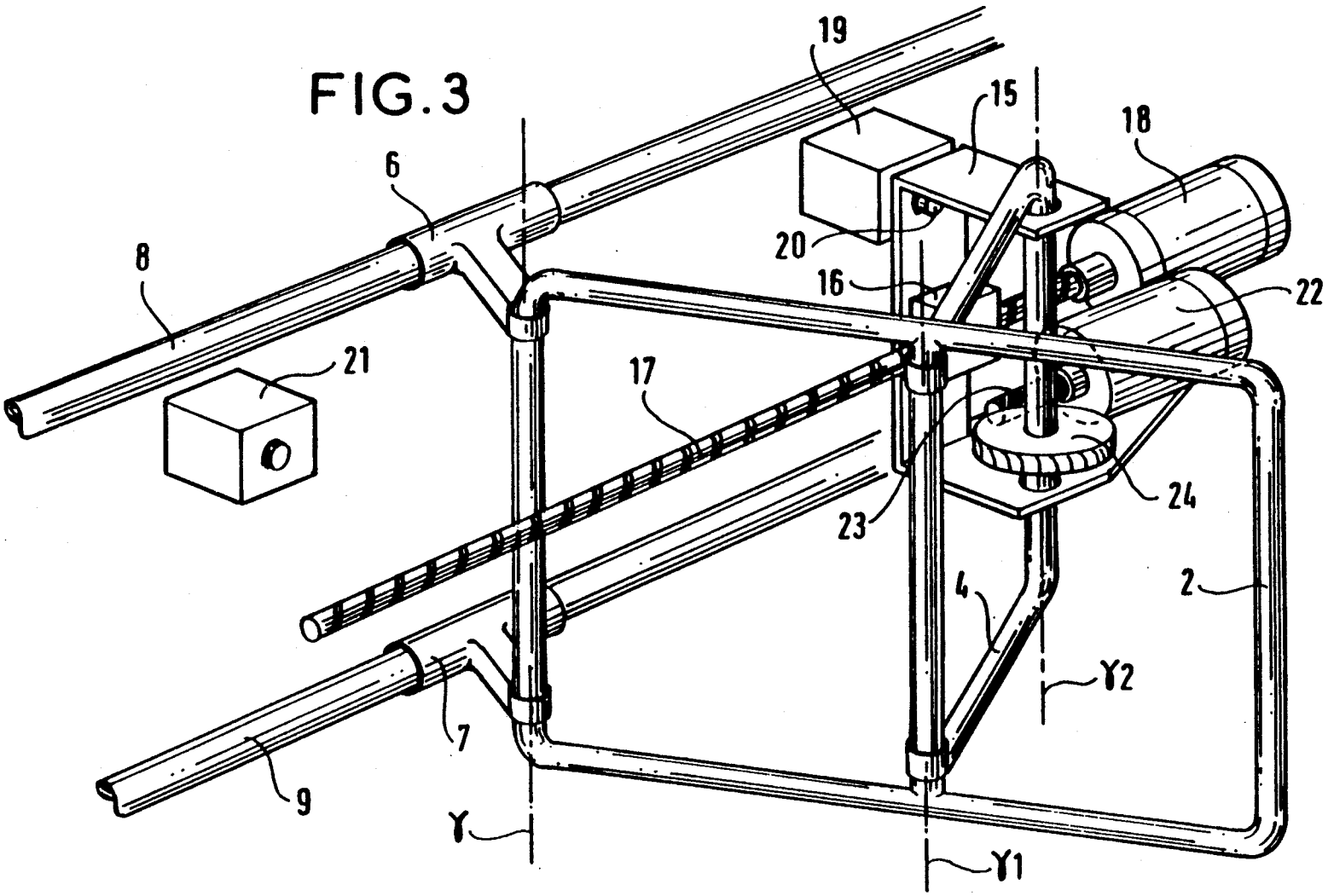
FIG. 3 is a perspective view of a barrier of the invention showing variant drive means compared with FIG. 2.

FIG. 3 shows another embodiment that differs from the preceding embodiment only in the drive means for opening and closing the passage by means of the barrier 2. In this case, traction is not applied directly to the sliding end of the barrier 2, but instead rotation is applied to the link 4 about its axis $\gamma_2$. To this end, a motor 22 is connected to the carrige 15 and carries a shaft 23 with a worm gear that meshes with a gear wheel 24 secured to the link 4 coaxially about the axis of rotation $\gamma_2$, thereby indirectly causing the sleeves 6 and 7 to slide along the rods 8 and 9.

I claim:

1. A passage (1) having monitored authorization of access provided with a closure device using a barrier (2) hinged about a vertical axis $\gamma$, said passage including at least one such barrier (2) with the end thereof situated adjacent to said vertical axis $\gamma$ including rectilinear guide means (6 to 9) for guiding said axis $\gamma$ along a line $\Delta$ parallel to the through direction of said passage, said barrier further being provided with a hinged link (4) which is hinged firstly about a vertical axis $\gamma_1$ situated along said barrier (2), and secondly about a vertical axis $\gamma_2$ situated in he vicinity of said line $\Delta$, drive means (10 to 13, 22 to 24) opening and closing said passage by causing said vertical axis $\gamma$ to slide along said line $\Delta$, said vertical axis $\gamma_2$ being situated at a distance l from said line $\Delta$, the length of said barrier (2) between the vertical axis $\gamma$ and the vertical axis $\gamma_1$ being equal to L, the passage being characterized in that the length $L_1$ of said link (4) between the axies $\gamma_1$ and $\gamma_2$ is equal to L-l, in that the vertical axis $\gamma_2$ is tied to a carriage (15) supporting the hinge of said link (4), and in that drive means (16 to 18) enable said carrier (15) to be displaced in a direction parallel to said line $\gamma$, locking means (19, 21) being provided for locking said carriage in two distinct positions along the stroke of the carriage (15).

2. A passage having monitored authorization of access according to claim 1, characterized in that said drive means (10 to 13) act directly in traction on the sliding end of said barrier.

3. A passage having monitored authorization of access according to claim 1, characterized in that said drive means (22 to 24) cause said link to rotate about its vertical axis $\gamma_2$,thereby indirectly causing the sliding end of said barrier to slide.

* * * * *